US006634829B2

(12) United States Patent
Okazaki

(10) Patent No.: US 6,634,829 B2
(45) Date of Patent: Oct. 21, 2003

(54) FITTING STRUCTURAL BODY, FITTING AND FLEXIBLE SHEET INFLATABLE GATE

(75) Inventor: Yasuo Okazaki, Yokohama (JP)

(73) Assignee: Bridgestone Corporation, Tokyo (JP)

( * ) Notice: Subject to any disclaimer, the term of this patent is extended or adjusted under 35 U.S.C. 154(b) by 0 days.

(21) Appl. No.: 09/987,714

(22) Filed: Nov. 15, 2001

(65) Prior Publication Data

US 2002/0061230 A1 May 23, 2002

(30) Foreign Application Priority Data

Nov. 22, 2000 (JP) ..... 2000-356606
Mar. 28, 2001 (JP) ..... 2001-094135

(51) Int. Cl.[7] ..... E02B 7/20
(52) U.S. Cl. ..... 405/115; 405/91; 405/87
(58) Field of Search ..... 405/115, 91, 90, 405/89, 87, 80, 107, 114, 124

(56) References Cited

U.S. PATENT DOCUMENTS 4,167,358 A * 9/1979 Besha ..... 405/115
5,318,381 A * 6/1994 Enami et al. ..... 405/115
6,179,521 B1 * 1/2001 Muramatsu et al. ..... 405/91
6,213,683 B1 * 4/2001 Muramatsu ..... 405/115
6,354,762 B1 * 3/2002 Muramatsu ..... 405/91

FOREIGN PATENT DOCUMENTS

GB 2077825 * 12/1981 ..... 405/115
JP 58181911 * 10/1983 ..... 405/115
JP 04030012 * 2/1992 ..... 405/115
JP 04293809 * 10/1992 ..... 405/91
JP 04293810 * 10/1992 ..... 405/91

* cited by examiner

*Primary Examiner*—Heather Shackelford
*Assistant Examiner*—Frederick L. Lagman
(74) *Attorney, Agent, or Firm*—Oliff & Berridge, PLC

(57) ABSTRACT

A fitting structural body, fittings included in the structural body, and a flexible sheet inflatable gate installed inside a culvert using the structural body are disclosed. In the fitting structural body, a first fitting element and a second fitting element are respectively made into one body at corner portions of the structural body. At each corner portion, no gap between each set of fittings, and no acute parts contacting an upper sheet of the gate exist.

20 Claims, 13 Drawing Sheets

50
28H
34
36
54H
58
52H
52B
22
20
18L
24H
24
24B
II
J1
J2
56
26
28
28B
18
18S
32
32T
54B
18D
30
30T
42

FITTING STRUCTURAL BODY, FITTING AND FLEXIBLE SHEET INFLATABLE GATE

BACKGROUND OF THE INVENTION

1. Field of the Invention

The present invention relates to a fitting structural body, a fitting and a flexible sheet inflatable/deflatable gate. In detail, the present invention relates to a fitting structural body structured to form a frame with fittings for gripping flexible sheets which are inflated by supplying a fluid and deflated by discharging a fluid and being mounted on a target structure; a fitting included in the fitting structural body; and a flexible sheet inflatable/deflatable gate mounted on the target structure using the fitting structural body.

2. Description of the Related Art

A culvert through which liquid and gas can flow may be provided on the inner surface thereof with a flexible sheet inflatable gate including flexible sheets (e.g. rubber sheets) At the flexible sheet inflatable gate, the flexible sheets inflate to obstruct the interior space of the culvert when a fluid (typically air) is supplied to the sheets so as to stop the flow of liquid or gas through the culvert. The flexible sheets deflate and recede in the culvert when a fluid is discharged from the sheets, so that liquid and gas can flow through the culvert.

FIG. 19 is a partially enlarged view of such flexible sheet inflatable gate provided in a culvert 118. The flexible sheet inflatable gate is arranged such that flexible sheets (a lower sheet 120 and an upper sheet 122) are mounted to the culvert 118, a target structure, using a fitting structural body 110.

The fitting structural body 110 includes a bottom wall fitting 124 disposed on a bottom wall 118L of the culvert 118, a slope fitting 126 disposed on a slope 118D, and a sidewall fitting 128 disposed on a sidewall 118S, corresponding to the shape of the culvert 118. The fittings 124, 126, 128 include respectively embedded fittings 124B, 126B and 128B fixed to the culvert 118 and pressing fittings 124H, 126H and 128H for gripping the flexible sheets (the lower sheet 120 and the upper sheet 122) between the embedded fittings 124B, 126B and 128B.

In mounting the structural body 110, the lower sheet 120 and the upper sheet 122 are placed in order on the embedded fittings 124B, 126B and 128B fixed to the culvert 118. Then, the pressing fitting 126H of the slope fitting 126 is mounted. Finally the pressing fitting 124H of the bottom wall fitting 124 and the pressing fittings 128H of the sidewall fitting 128 are mounted slantly as an arrow A (toward corners 130 and 132 of the culvert 118). Mounting in this order that works at a corner portion of the culvert (in the vicinity of the slope 118D) whose work area is narrower are done before those in the vicinity of the bottom wall 118L and the sidewall 118S whose work area is broader improves the operational efficiency.

The pressing fittings 124H, 126H and 128H are formed with a minus tolerance in view of practical construction since the culvert 118 is a constructed object having a large tolerance. Thus, in the above mounting condition, a significantly large gap may appear for example between the pressing fitting 124H of the bottom wall fitting 124 and the pressing fitting 126H of the slope fitting 126 (that is, at the corner portion 130).

On the other hand, an analysis such as three-dimensional FEM analysis has found that the tension at the time of inflating of the upper sheet 122 becomes large in the vicinity of the corner portions 130 and 132 and that the tension reaches the largest peak especially in the vicinity of the corner 130. Therefore, edge portions 134 at the corner portions 130 and 132 are arranged to have a curvature (roundishness) in a finishing process in order to avoid damages (e.g. holes) on inflating the upper sheet 122. The edge portion 134, however, easily become acute even in such arrangement with the roundishness due to its three-dimensional shape, so that it is still likely to damage the upper sheet 122.

SUMMARY OF THE INVENTION

In view of the above, an object of the invention is to obtain a fitting structural body, which would not damage flexible sheets; fittings included in the fitting structural body; and a flexible sheet inflatable gate mounted on a target structure using the fitting structural body.

A first aspect of the invention is that a fitting structural body structured to form a frame as a whole using a plurality of fittings for gripping a flexible sheet inflatable by supplying a fluid and deflatable by discharging the fluid and being fixed to the target structure, wherein the above fittings on the both sides of a non-linear part formed along a longitudinal side of the frame, are unified.

That is, a fitting structural body structured to form a shape of frame using fittings is fixed to the target structure and grips a flexible sheet, so that the flexible sheet is mounted on the target structure. The flexible sheet inflates or deflates by supplying or discharging a fluid to or from the flexible sheet so as to close or open a culvert or river.

The fitting structural body includes the non-linear part formed along a longitudinal side of the frame so that the fitting structural body can be formed corresponding to the target structure.

Further, the fittings are unified on the both sides of the non-linear part. Thus, no gaps at the non-linear part exist and no acute portions would contact with the flexible sheet. Therefore, the flexible sheet is not damaged even when the large tension acts on the flexible sheet at the non-linear part.

A second aspect of the invention is fittings included in the fitting structural body in the first aspect, provided at the non-linear part formed along a longitudinal side of the above-mentioned frame, and are unified at the both sides of the above non-linear part.

That is, the fitting structural body in the first aspect can be structured using the fittings in the second aspect. In the fittings in the second aspect, there are no gaps at the non-linear part, and no acute portions would contact with the flexible sheet and the flexible sheet would not be damaged.

In the second aspect of the invention, a specific structure for unifying the fittings on the both sides of the non-linear part is not particularly limited, but may be unified preferably by welding fitting elements, which are formed separate bodies so as to form the both sides of the above-mentioned non-linear part. More preferably, the fittings may be unified on the both sides of the non-linear part by cutting an elongated member, which is elongated beforehand longer in a longitudinal direction of the frame than the length of the fittings included in the above-mentioned fitting structural body, so that the elongated member is formed to correspond to the above-mentioned non-linear part.

Especially, the shape of the fittings may be individually different since the target structure on which the fittings are mounted often varies in the shape, size, angle and others. Consequently, many molds are needed when the fittings are manufactured using a mold, and may result in a high manufacturing cost. In contrast, in manufacturing the fittings by hot extruding, for example, the degree of freedom in the shape and dimension is high, and the fittings can be manufactured at a low cost. Thus, as in the present invention, the fittings are unified preferably by welding fitting elements, which have been formed into separate bodies, so that the fittings in the second aspect of the invention can be manufactured at a low cost.

In the present invention, the above-mentioned non-linear part of the aforesaid fittings is preferably processed so as to have a curvature in a view along a longitudinal side of the frame.

Therefore, damage of a flexible sheet can be avoided more reliably.

In the fittings according to the invention, a radius of curvature obtained by processing the non-linear part is preferably within a range from 50 mm to 1800 mm, for example, but not particularly limited to the above so long as the flexible sheet can be prevented from being damaged. Setting the radius at 50 mm or smaller can certainly prevent the flexible sheet from being damaged. When the radius is 1800 mm or smaller, the fittings can be prevented from being excessively enlarged in size or thickness.

In the present invention, anchor bolt inserting holes into which anchor bolts are inserted and which are provided in the target structure, are formed in any of the above-mentioned fittings.

Thus, comparing with the fittings in which only one anchor bolt inserting hole is formed, the fittings according to the invention can grip the flexible sheets with a greater power.

In the present invention, more preferably, all of the above-mentioned anchor bolt inserting holes are arranged in parallel in the fittings.

That is, anchor bolt inserting holes arranged not in parallel cause a power acting on the anchor bolts in the direction such that the space between the inserting holes would be enlarged (or narrowed, depending on the case) as nuts are screwed on the anchor bolts. Then, the nuts cannot be enough screwed due to the power, and thus a large tightening power may not be obtained. In contrast, a parallel arrangement enables the nuts to be sufficiently screwed, so that a greater tightening power can be obtained.

In the present invention, more preferably, the fittings are formed symmetrically in relation to a symmetric axis line passing through the above-mentioned linear part and that the above-mentioned anchor bolt inserting holes are provided in the positions symmetric in relation to the symmetric axis line.

Such arrangement of the fittings enables fittings included in one fitting structural body to be common.

In the present invention, the anchor bolt inserting holes of the above-mentioned fittings are preferably formed symmetrically in relation to a symmetric axis line passing through a center point of a corner portion in the above-mentioned fitting structural body.

Therefore, manufacturing processes of the respective fittings located on the both sides of the corner portion can be partially (preferably, all) used in common.

In the present invention, more preferably, at least one of the above-mentioned anchor bolt inserting holes is an elongated hole.

According to the above, the work efficiency in screwing an anchor bolt to grip the flexible sheets is improved.

In the present invention, more preferably, in the fitting structural body of the first aspect, which includes the above-mentioned fittings, a part contacting with adjacent fittings to the above-mentioned fittings is inclined in relation to a fixing direction so as to press the adjacent fittings against the above-mentioned structure for mounting.

That is, in the fitting structural body, the fittings of the second aspect described above press the adjacent fittings against the target structure. Accordingly, the adjacent fittings can be prevented from rising advertently.

In the present invention, more preferably, in the fitting structural body of the first aspect, which includes the above fittings, among fittings including the fittings in the second aspect, relatively upper fittings press relatively lower fittings adjacent to the upper fittings against the target structure, with the fittings fixed to the target structure.

Thus, by mounting (and tightening bolts of) the fittings in order from a lower place to an adjacent upper place to grip flexible sheets, the fittings can be easily mounted on the target structure. In this case, the flexible sheets are gripped in order in one direction. Thus, it is possible to minimize gaps and looseness in mounting, so that precise mounting can be achieved.

In the present invention, more preferably, in the fitting structural body in the first aspect, which includes the above fittings, among fittings including the fittings in the second aspect, there is a gap formed between at least one of the fittings and at least one of adjacent fittings to the fittings.

Such predetermined gap between the fittings adjacent each other improves the work efficiency in mounting flexible sheets to the target structure.

A third aspect of the present invention is a flexible sheet inflatable and deflatable gate comprising the fitting structural body and flexible sheets mounted on the target structure using the fitting structural body.

The flexible sheets can be prevented from being damaged since the flexible sheets are mounted on the target structure using the fitting structural body, as described above.

When the flexible sheets are mounted on the target structure, a flexible sheet inflatable gate is formed, and supplying or discharging a fluid can close or open the interior space of the target structure (e.g. a culvert or a dam for a river).

DESCRIPTION OF THE PREFERRED EMBODIMENT

Figure 1:
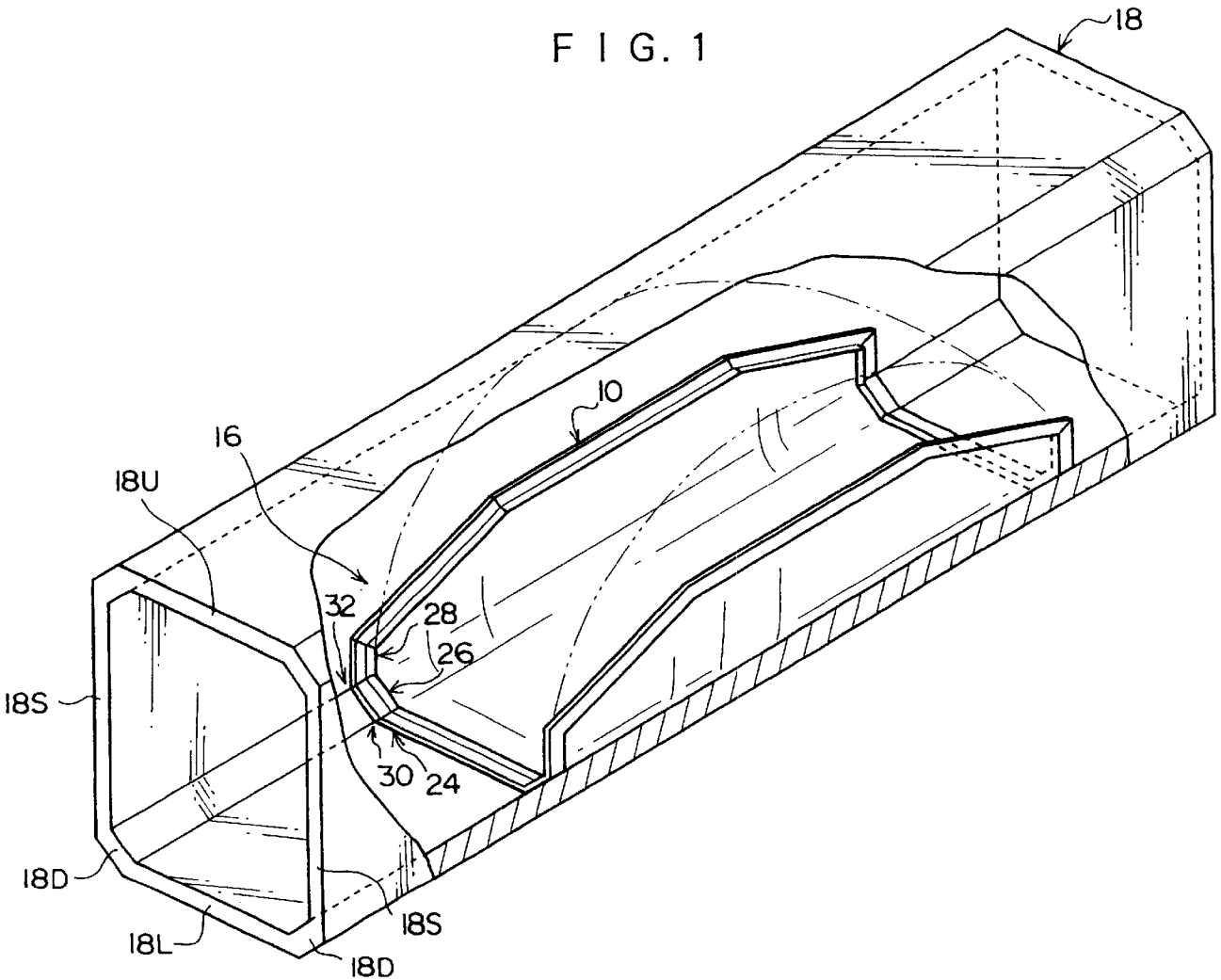
FIG. 1 is a perspective view of a flexible sheet inflatable gate according to the first embodiment of the invention and a partially opened culvert on which the flexible sheet inflatable gate is mounted.
Figure 2B:
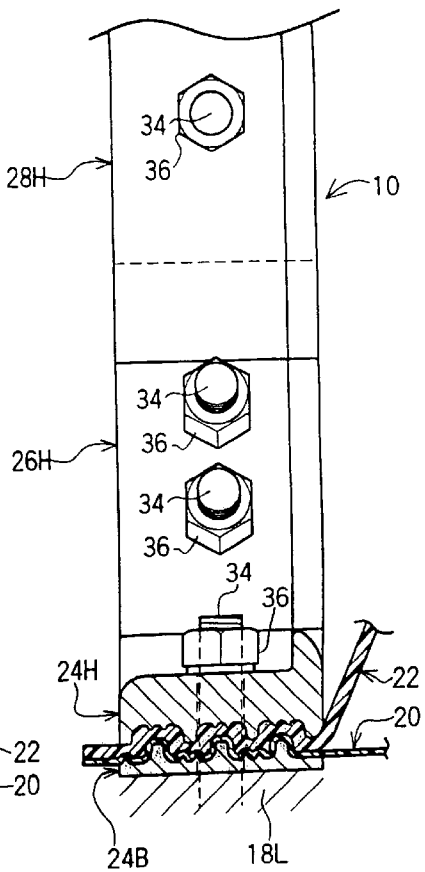
FIG. 2B is a sectional view along a line I—I in FIG. 2A, in which a fitting structural body according to the first embodiment of the invention is enlarged.

FIG. 1 shows a flexible sheet inflatable gate 16 mounted to a culvert 18 using a fitting structural body 10 according to the first embodiment of the invention. The flexible sheet inflatable gate 16 includes two flexible sheets (a lower sheet 20 and an upper sheet 22, refer to FIGS. 2B and 3A) piled and disposed along the inner surface of the culvert 18 (from a bottom wall 18L of the culvert 18 to a part of a sidewall 18S through an slope 18D). The fitting structural body 10 structured to form a frame, grips the vicinity of outside peripheries of the lower sheet 20 and the upper sheet 22 to form an air room between the lower sheet 20 and the upper sheet 22. The lower sheet 20 and the upper sheet 22 are arranged to form a rectangle where a longitudinal side of the culvert 18 is a longer side. In a normal condition, the flexible sheet inflatable gate 16 is formed along the inner surface of the culvert 18 as shown by a solid line in FIG. 1, and thereby, does not close the interior space of the culvert 18. The flexible sheet inflatable gate 16 (the upper sheet 22), however, inflates in the culvert 18 as shown by a double broken line in FIG. 1 to closely contact with an upper wall 18U when air is supplied to the flexible sheet inflatable gate 16 (the air room between the lower sheet 20 and the upper sheet 22) by a supplying/exhausting apparatus (not shown), so that the inner space of the culvert 18 is closed. Accordingly, a fluid in the culvert 18 can be prevented from flowing. The flexible sheet inflatable gate 16 deflates to the position shown by a solid line when a supplying/exhausting apparatus exhausts air from the flexible sheet inflatable gate 16, and a fluid can flow through the culvert 18. The lower sheet 20 is provided for preventing air from leaking to the culvert 18 (and for preventing water from entering the interior of the gate), but may be omitted so long as airtightness and watertightness can be ensured by any other way.

FIG. 2 shows an enlarged fitting structural body 10 in the vicinity of the slope 18D of the culvert 18. The fitting structural body 10 includes a bottom wall fitting 24 provided on the bottom wall 18L of the culvert 18, a slope fitting 26 provided on the slope 18D and a sidewall fitting 28 provided on the sidewall 18S. These fittings 24, 26 and 28 include embedded fittings 24B, 26B and 28B to be embedded in and fixed to the culvert 18, and pressing fittings 24H, 26H and 28H to press and grip the lower sheet 20 and the upper sheet 22 with the embedded fittings 24B, 26B and 28B. The embedded fittings 24B, 26B and 28B and the pressing fittings 24H, 26H and 28H are provided with anchor bolt inserting holes 42. The lower sheet 20 and the upper sheet 22 are gripped by the embedded fittings 24B, 26B and 28B and the pressing fittings 24H, 26H and 28H, and fixed to the culvert 18 by engaging and tightening nuts 36 with anchor bolts 34 inserted into the anchor bolt inserting holes 42.

Figure 3A:
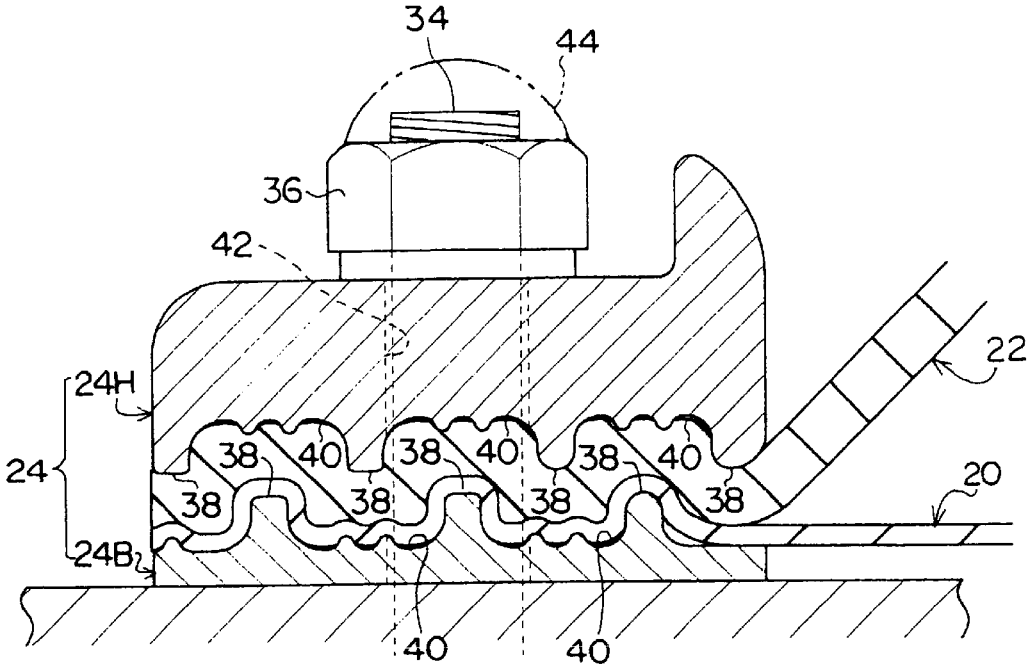
FIG. 3A is a sectional view of the fittings included in a fitting structural body gripping flexible sheets according to the first embodiment of the invention.
Figure 3B:
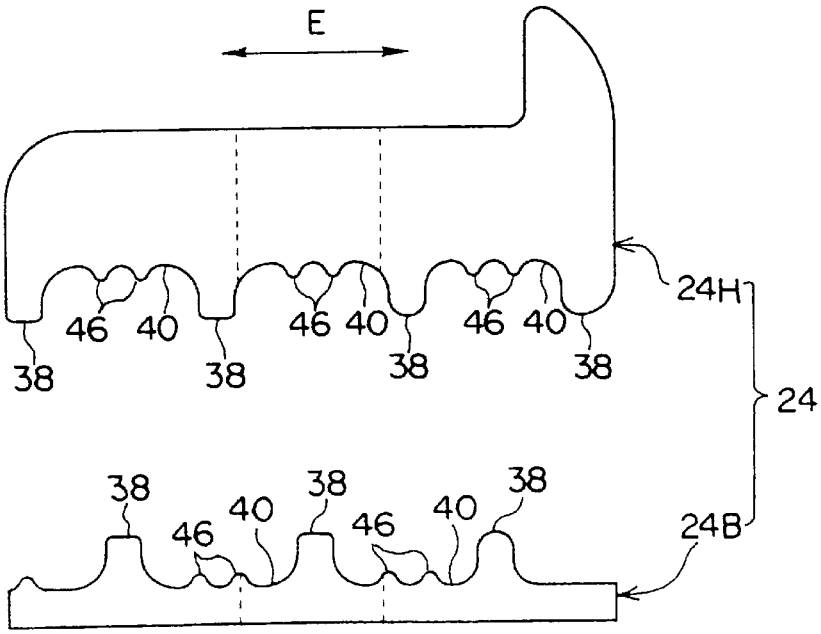
FIG. 3B is an end view showing separately embedded fittings and pressing fittings of the fittings.

FIGS. 3A and 3B show the embedded fittings 24B and the pressing fittings 24H enlarged respectively. In FIGS. 3A and 3B, one set of the embedded fittings 24B and the pressing fittings 24H is illustrated as an example since the cross sections of the embedded fittings 26B and 28B and the pressing fittings 26H and 28H are substantially the same as those of the embedded fittings 24B and the pressing fittings 24H, respectively.

On respective opposing surfaces of the embedded fittings 24B, 26B and 28B and the pressing fittings 24H, 26H and 28H, convex portions 38 extending in the longitudinal direction of the fittings are alternately formed and spaced in a direction of the width (a direction shown by an arrow E). Corresponding concave portions 40 are formed in the place opposing to the convex portions 38. With such convex portions 38 and concave portions 40, the lower sheet 20 and the upper sheet 22 are gripped by the embedded fittings 24B, 26B and 28B and the pressing fittings 24H, 26H and 28H, and deformed like a zigzag. Accordingly, the lower sheet 20 and the upper sheet 22 are gripped with a local gripping power at a place contacted with the convex portions 38. Greater local gripping power is ensured than a case without convex portions 38 and concave portions 40.

As shown in FIGS. 3A and 3B, the respective concave portions 40 are provided with projections 46 at a location corresponding to the corners of the opposing convex portions 38. Because of the projections 46, the local gripping power acts on the lower sheet 20 and the upper sheet 22 gripped between the convex portions 38 and the opposing concave portions 40, so that a large gripping power can be generated as a whole. The projections 46 may be continuously provided in the longitudinal direction of the concave portions 40 or intermittently provided with a space.

Figure 2A:
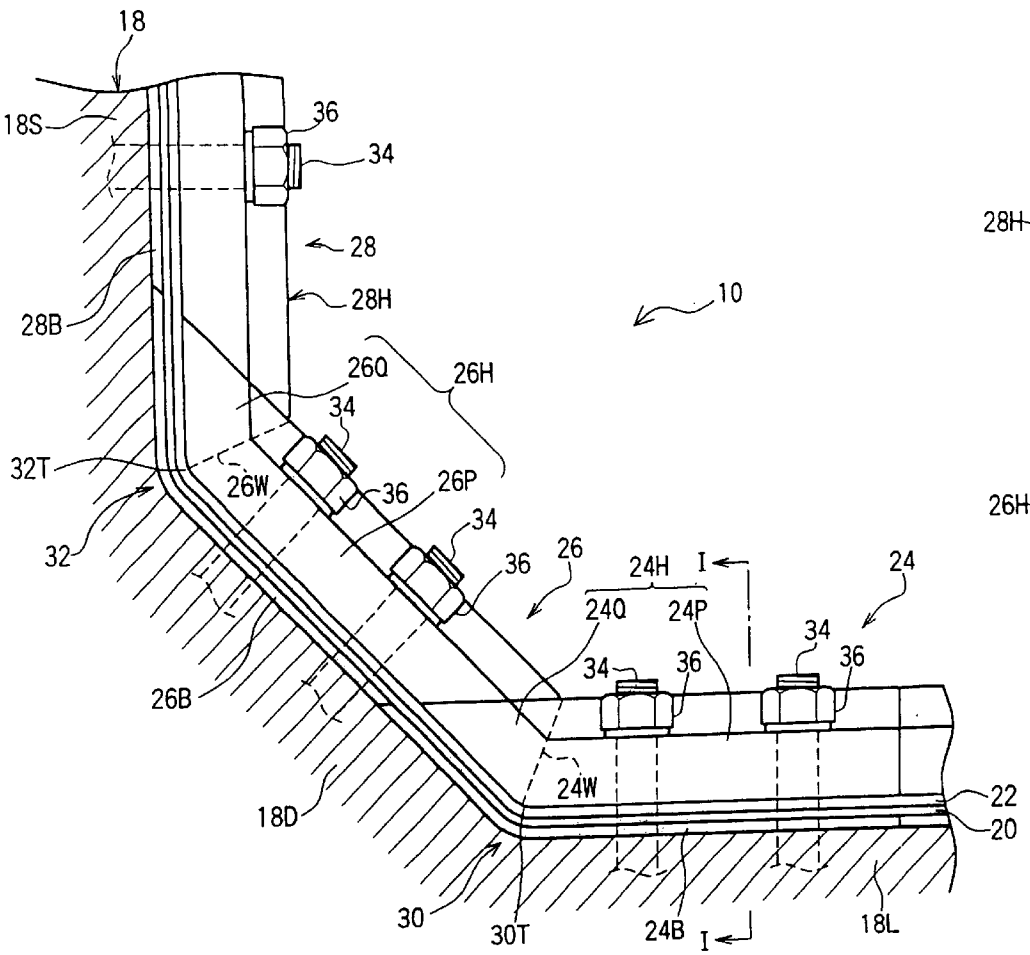
FIG. 2A is an end view of a culvert in a longitudinal direction, in which a fitting structural body according to the first embodiment of the invention is enlarged.

As shown in FIG. 1, the fitting structural body 10 structured to form a frame is bent at predetermined places in the longitudinal direction of the frame so as to fit the culvert 18. The bent portions form corner portions 30 and 32. As shown in FIG. 2A, at the corner portion 30, the pressing fitting 24H of the bottom wall fittings 24 includes a first fitting element 24P located on the bottom wall 18L side in a view from the corner portion 30, and a second fitting element 24Q located on the slope 18D side in a view from the corner portion 30 as well. The first fitting element 24P and the second fitting element 24Q are made by welding into one body at a welded part 24W shown by a broken line in FIG. 2A so as to form the pressing fitting 24H as a whole. Similarly, at the corner portion 32, the pressing fitting 26H of the slope fittings 26 includes a first fitting element 26P located on the slope 18D side in a view from the corner portion 32, and a second fitting element 26Q located on the sidewall 18S side in a view from the corner portion 32. The first fitting element 26P and the second fitting element 26Q are also made by welding into one body at a welded part 26W so as to form the pressing fitting 26H as a whole.

Since the fitting elements located on the both sides of the corner portions 30 and 32 of the fitting structural body 10 are unified as described above, there are no gaps as conventionally at the corner portions 30 and 32 when the lower sheet 20 and the upper sheet 22 are gripped by engaging the nuts 36 with the anchor bolts 34. There are also no acute parts contacting with the upper sheet 22 at the corner portions 30 and 32. Accordingly, no acute parts contact with the inflating upper sheet 22.

An operation of this embodiment will be described next.

When a supplying/exhausting apparatus (not shown) supplies an air room between the lower sheet 20 and the upper sheet 22 with air, the upper sheet 22 expands as shown by a double broken line in FIG. 1, and the flexible sheet inflatable gate 16 inflates. The interior space of the culvert 18 is thus closed and a fluid can be prevented from flowing.

When the flexible sheet inflatable gate 16 inflates, the tension acts on the upper sheet 22. Three-dimensional FEM analysis has found this tension acts largely on the corner portions 30 and 32 of the fitting structural body 10, and especially the maximum tension acts on the corner portion 30.

In the fitting structural body 10 according to this embodiment, there are no gaps as conventionally between the pressing fittings 24H and 26H and between the pressing fittings 26H and 28H at the corner portions 30 and 32, nor acute portions contacting with the upper sheet 22. Therefore, the upper sheet 22 will not be damaged such as a tear even when the high tension acts on the inflating upper sheet 22 in the vicinity of the corner portions 30 and 32. Particularly, the pressing fittings 24H, 26H and 28H are generally formed with a minus tolerance. There are no gaps, however, at the corner portions 30 and 32 even in this case, so that the upper sheet 22 can be certainly prevented from being damaged.

A specific structure for preventing the gaps from being formed at the corner portions 30 and 32 is not limited to the above, and may be any structure, for example shown in FIGS. 4 through 15. The members and the like as those of FIG. 2 are marked with the same reference numbers and omitted from description. The anchor bolt 34 is simplified into a single broken line in showing. Further, welded parts 24W, 26W and 28W between the fitting elements are shown by broken lines, similarly to FIG. 2A.

Figure 4:
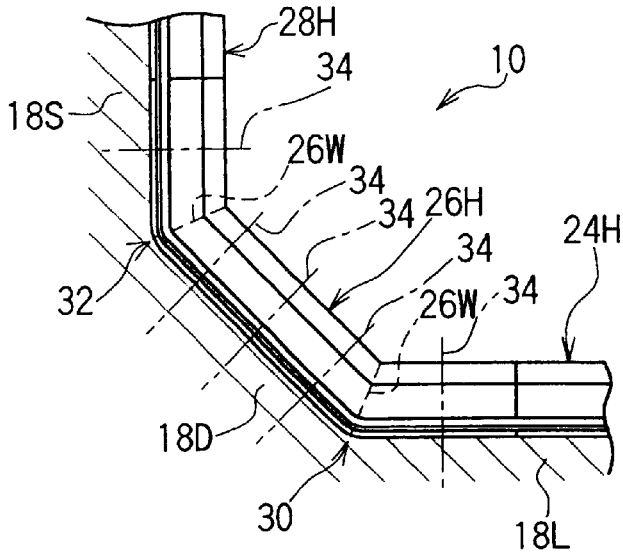
FIG. 4 is a schematic structural view showing another embodiment of the fitting structural body according to the first embodiment of the invention.

In an embodiment shown in FIG. 4, the pressing fitting 26H includes three fitting elements: a fitting element at the middle part corresponding to the slope 18D; a fitting element located on the bottom wall 18L side in relation to the corner portion 30; and a fitting element located on the sidewall 18S side in relation to the corner portion 32. These fitting elements are all made into one body by welding.

Figure 5:
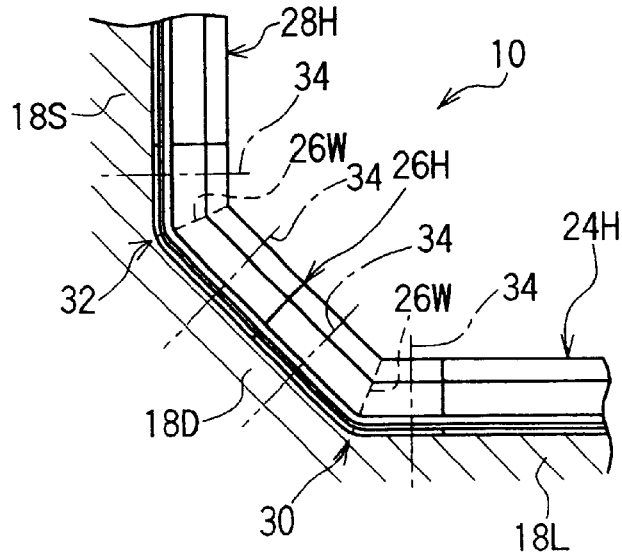
FIG. 5 is a schematic structural view showing another embodiment of the fitting structural body according to the first embodiment of the invention.

In an embodiment shown in FIG. 5, the pressing fitting 26H shown in FIG. 4 is divided at the center thereof. The pressing fitting 26H is still in one body on the both sides of the corner portions 30 and 32 even in such divided condition since the pressing fitting 26H is welded at the corner portions 30 and 32.

Figure 6:
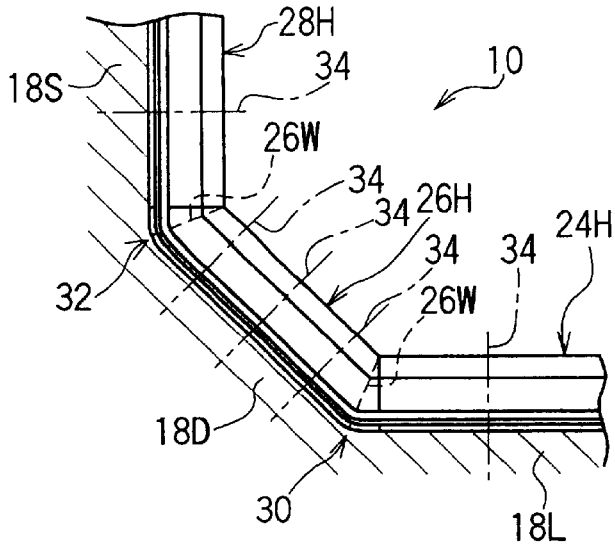
FIG. 6 is a schematic structural view showing another embodiment of the fitting structural body according to the first embodiment of the invention.

In an embodiment shown in FIG. 6, it is the same as the case in FIG. 4 that the pressing fitting 26H includes a fitting element at the middle part and two fitting elements on the both sides thereof. The fitting elements on the both sides, however, are formed shorter so as to appear as substantially a triangle in a front view.

Figure 7:
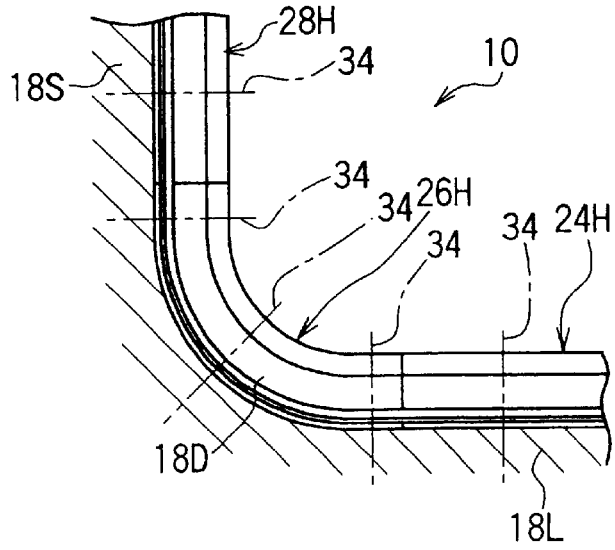
FIG. 7 is a schematic structural view showing another embodiment of the fitting structural body according to the first embodiment of the invention.

In an embodiment shown in FIG. 7, the fitting structural body 10 is formed to fit the culvert 18 in which the slope 18D is curved in an arc all over. The pressing fitting 26H is also curved so as to fit the above condition.

Figure 8:
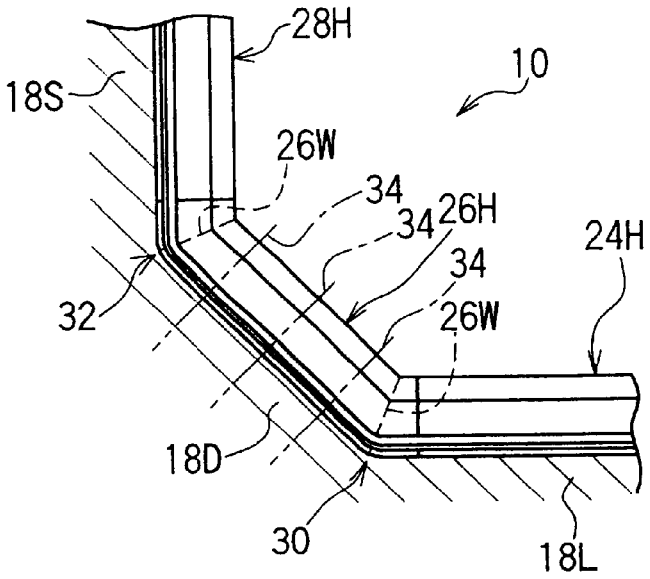
FIG. 8 is a schematic structural view showing another embodiment of the fitting structural body according to the first embodiment of the invention.

An embodiment shown in FIG. 8 is substantially the same as that of FIG. 4. The two fitting elements on the both sides, however, are made shorter in length than the fitting elements in FIG. 4 but longer than the fitting elements in FIG. 6. The two fitting elements on the both sides shown in FIG. 8 are arranged such that the anchor bolts 34 are not inserted therein.

Figure 9:
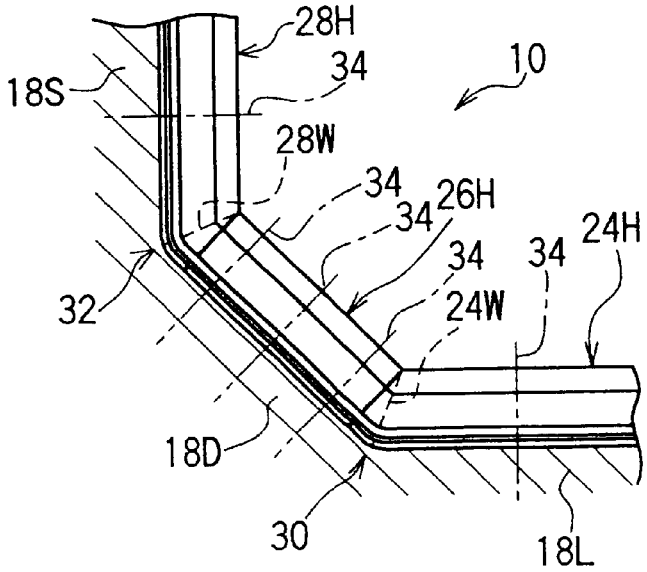
FIG. 9 is a schematic structural view showing another embodiment of the fitting structural body according to the first embodiment of the invention.

In an embodiment shown in FIG. 9, the pressing fitting 24H includes a fitting element located on the bottom wall 18L side in relation to the corner portion 30 and a fitting element located on the slope 18D side. These fitting elements are made into one body by welding. The pressing fitting 28H also includes a fitting element located on the sidewall 18S side in relation to the corner portion 32 and a fitting element located on the slope 18D side. These fitting elements are also unified by welding.

Figure 10:
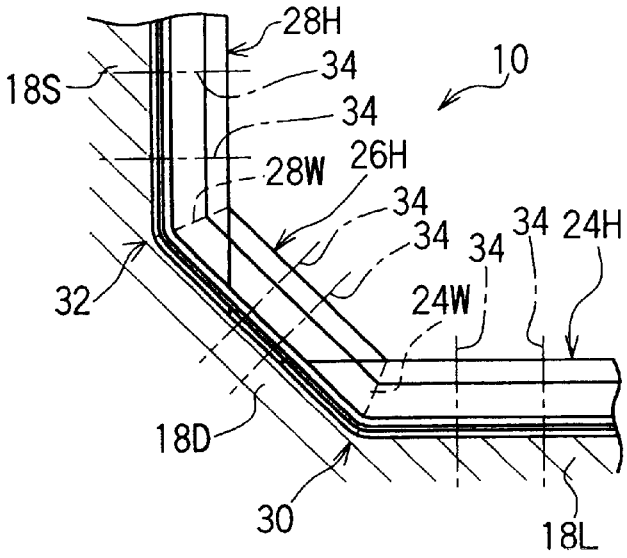
FIG. 10 is a schematic structural view showing another embodiment of the fitting structural body according to the first embodiment of the invention.

In an embodiment shown in FIG. 10, similarly to the embodiment shown in FIG. 9, the pressing fittings 24H and 28H respectively include welded two fitting elements. In FIG. 10, however, the fitting element located on the slope 18D side is larger than that of FIG. 9, and the surface facing the center of the culvert 18 (the right-upper side of FIG. 10 is toward the center of the culvert 18) of each of the pressing fittings 24H and 28H is on a single flat plane.

Figure 11:
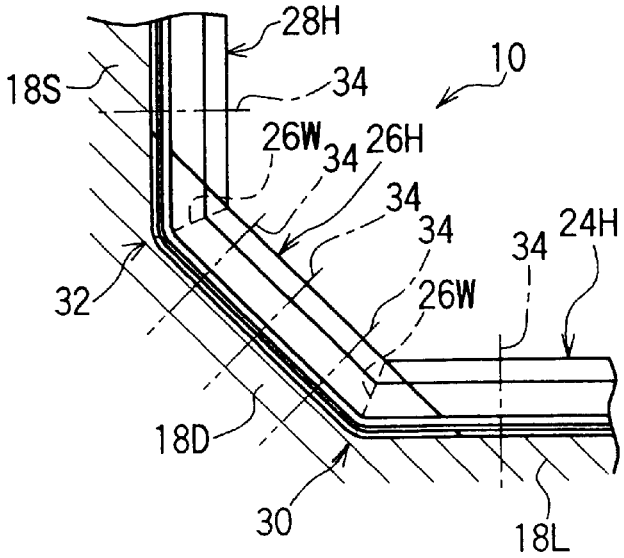
FIG. 11 is a schematic structural view showing another embodiment of the fitting structural body according to the first embodiment of the invention.

In an embodiment shown in FIG. 11, similar to the embodiment shown in FIG. 6, the pressing fitting 26H includes a fitting element at the middle part and two fitting elements on the both sides thereof. In FIG. 11, however, the fitting elements on the both sides are large so that the surface facing the center of the culvert 18 of the pressing fittings 26H is on a single flat plane.

Figure 12:
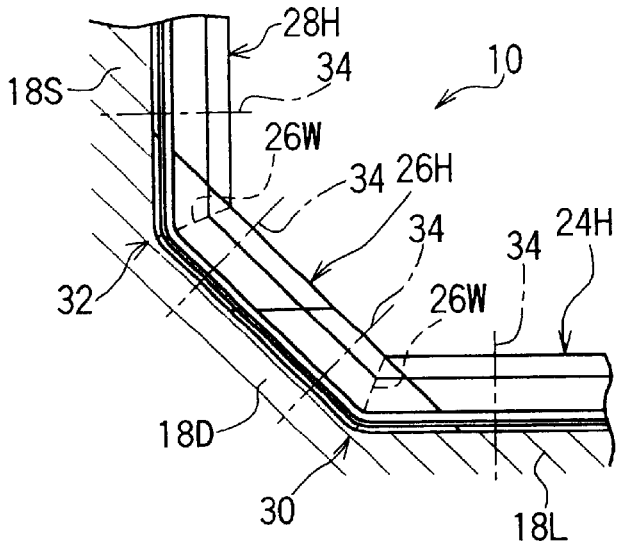
FIG. 12 is a schematic structural view showing another embodiment of the fitting structural body according to the first embodiment of the invention.

In an embodiment shown in FIG. 12, the pressing fitting 26H shown in FIG. 11 is divided in a horizontal direction at the center of the pressing fitting 26H.

Figure 13:
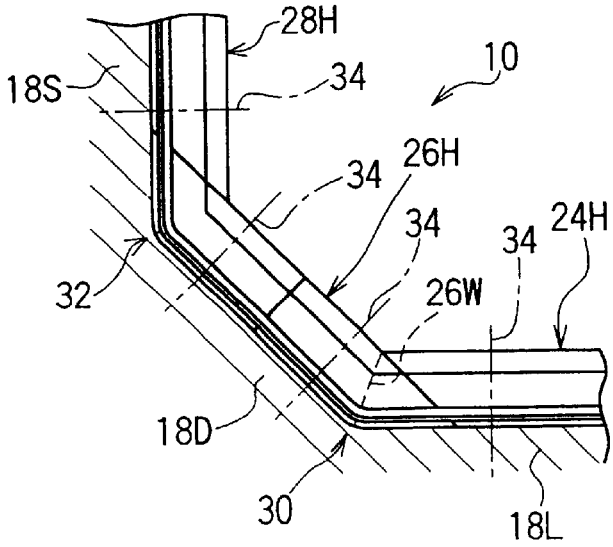
FIG. 13 is a schematic structural view showing another embodiment of the fitting structural body according to the first embodiment of the invention.

In an embodiment shown in FIG. 13, the pressing fitting 26H shown in FIG. 11 is divided at the center in a direction perpendicularly crossing with the slope 18D. The fitting elements on the both sides of the corner portion 32 are formed to fit the corner portions 32 by cutting a elongated member elongated beforehand along a longitudinal direction of the frame of the fitting structural body 10 including the pressing fittings 26H. In accordance with such arrangement, the both sides of the corner portion 32 can be unified in each of the pressing fittings 26H.

Figure 14:
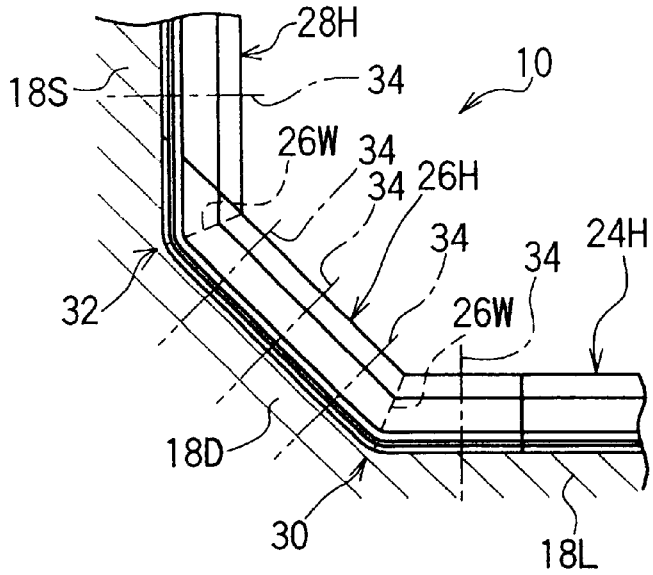
FIG. 14 is a schematic structural view showing another embodiment of the fitting structural body according to the first embodiment of the invention.

In an embodiment shown in FIG. 14, the both sides of the corner 30 are substantially the same as those in FIGS. 4 and 5 while the both sides of the corner 32 are substantially the same as those in FIGS. 11 to 13.

Figure 15:
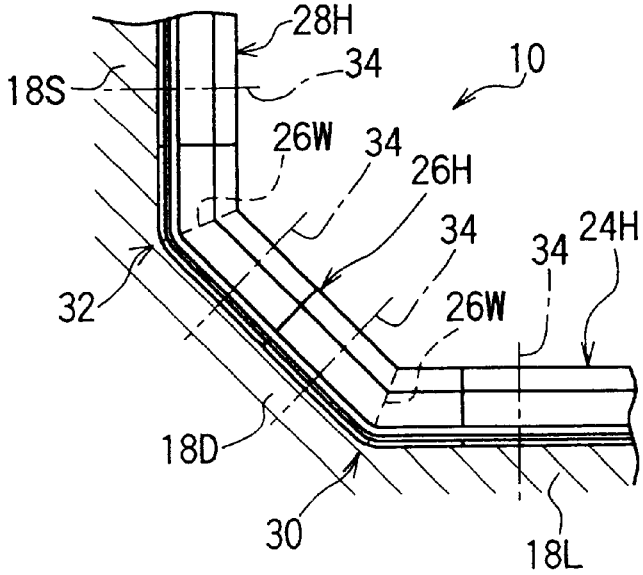
FIG. 15 is a schematic structural view showing another embodiment of the fitting structural body according to the first embodiment of the invention.

In an embodiment shown in FIG. 15, the fitting structural body is substantially the same as that in FIG. 5. In FIG. 15, however, the anchor bolts 34 are not inserted in the fitting elements located on the bottom wall 18L side and the sidewall 18S side in relation to the corner portions 30 and 32 respectively.

As described above in any embodiment, the fitting elements on the both sides of the corner portions 30 and 32 are unified respectively, and there are no gaps as conventionally at the corner portions 30 and 32 between the pressing fittings 24H and 26H and between the pressing fittings 26H and 28H. Thus, there are no acute parts contacting with the upper sheet 22, and the inflating upper sheet 22 can be effectively prevented from being damaged. Unifying the fitting elements on the both sides of the corner portions 30 and 32 should not be particularly limited, and welding or forming the pressing fittings 26H by cutting an elongated member as shown in FIG. 13 may be employed.

It is preferable that, in the embodiments described above, contacting portions 30T and 32T of the pressing fittings 24H, 26H and 28H (refer to FIG. 2A) with which the upper sheet 22 contacts at the corner portions 30 and 32 are processed to have a curvature so that the damage of the upper sheet 22 can be avoided more effectively.

In an arrangement that respective borders (contacting parts) between the pressing fittings 24H, 26H and 28H in respective embodiments are inclined in relation to the corresponding bottom wall 18L, slope 18D and sidewall 18S, specific pressing fittings press the adjacent pressing fittings against the culvert 18. Thus, the lower sheet 20 and the upper sheet 22 can be kept firmly gripped. For example, in the fitting structural body 10 shown in FIG. 2, the pressing fitting 24H is cantilevered, and thus, the pressing fitting 24H tends to bend upward in the vicinity of the corner portion 30. To counter this, the pressing fitting 26H presses the pressing fittings 24H at their contacting part against the culvert 18 so that the pressing fittings 24H can be prevented from bending and the lower sheet 20 and the upper sheet 22 can be firmly gripped.

Further, in the embodiment shown in FIG. 2, the pressing fitting 28H also presses the pressing fitting 26H against the culvert 18. That is, in a whole structure of the fitting structural body 10, the upper pressing fittings press the adjacent lower pressing fittings. Thus, the lower sheet 20 and the upper sheet 22 are easily gripped by mounting the pressing fittings 24H, 26H and 28H in order from the lower fittings to the upper fittings. Moreover, gaps and looseness expected conventionally in mounting between the lower sheet 20 and the upper sheet 22 and the pressing fittings 24H, 26H and 28H are minimized so that the fitting structural body 10 can be accurately mounted on the culvert 18.

In the respective embodiments described above, the number of the anchor bolts 34 to be respectively inserted in the pressing fittings 24H, 26H and 28H is not particularly limited, but (two or more) anchor bolts 34 are preferable to be inserted since the lower sheet 20 and the upper sheet 22 can be gripped with a larger gripping power, compared with the case of inserting only one anchor bolt 34.

Figures 16A, 16B:
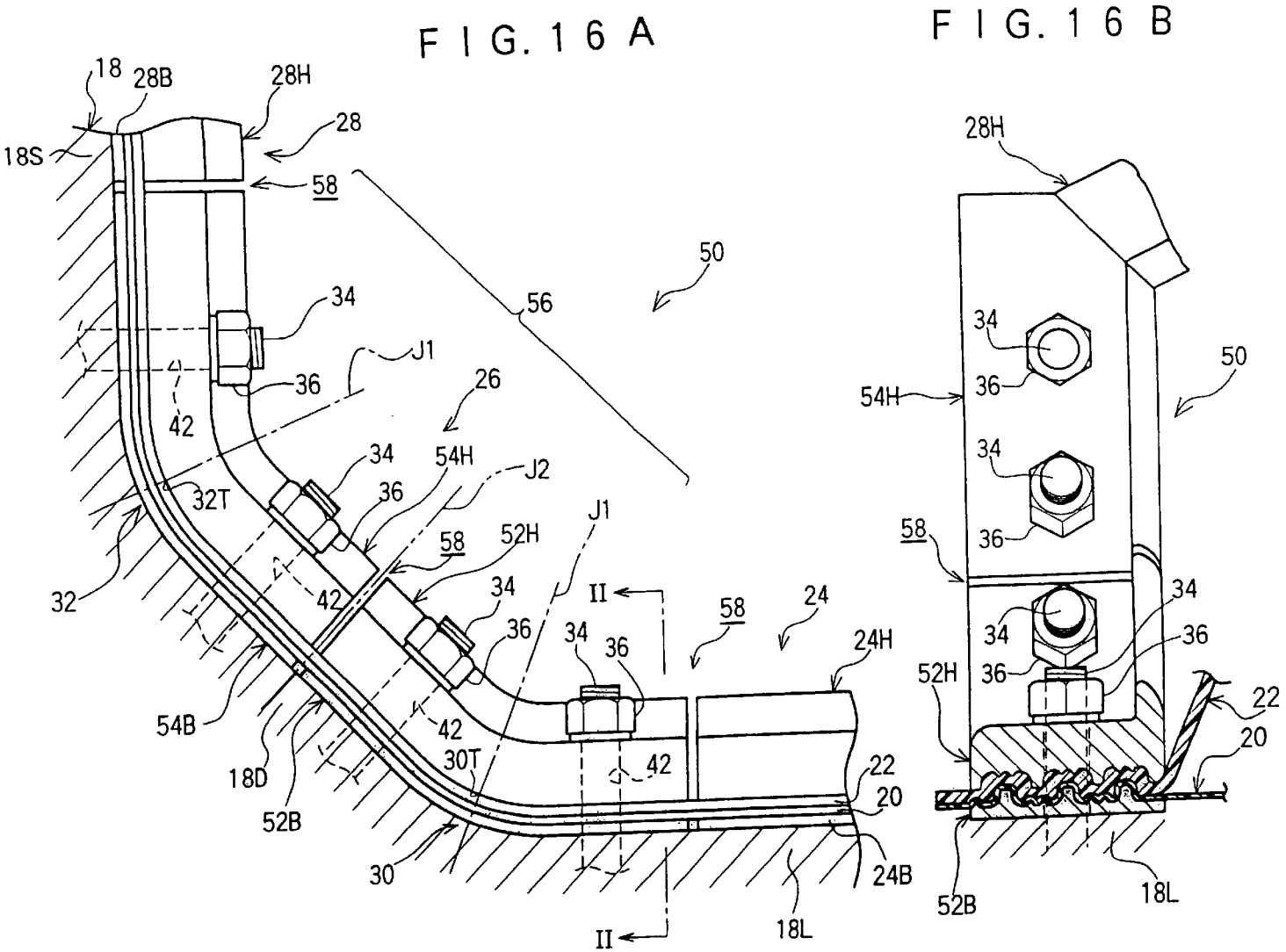
FIG. 16A is an end view of a culvert in a longitudinal direction, in which a fitting structural body according to the second embodiment of the invention is enlarged.
FIG. 16B is a sectional view along a line II—II in FIG. 16A.
Figure 17A:
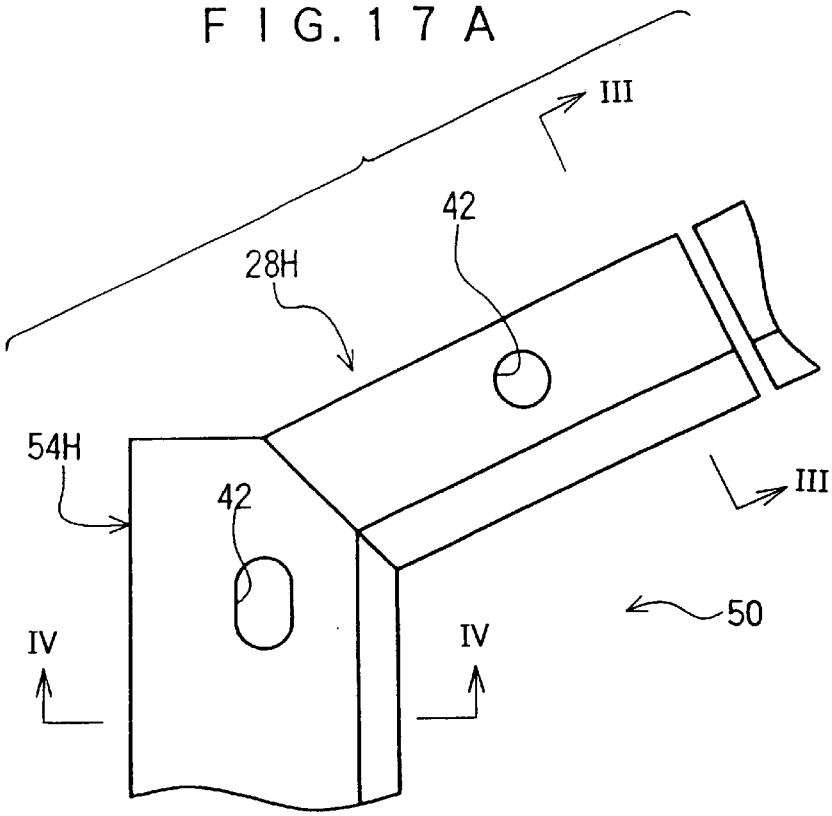
FIG. 17A is a front view of a part of pressing fittings of a fitting structural body according to the second embodiment of the invention.
Figure 17B:
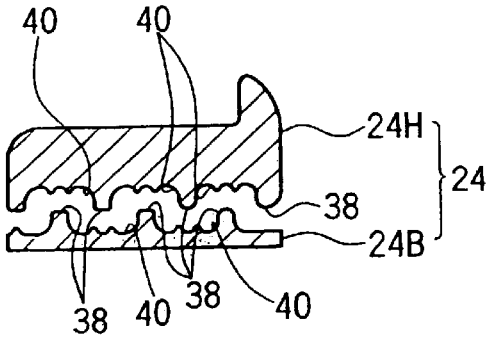
FIG. 17B is a sectional view along a line IV—IV in FIG. 17A.
Figure 17C:
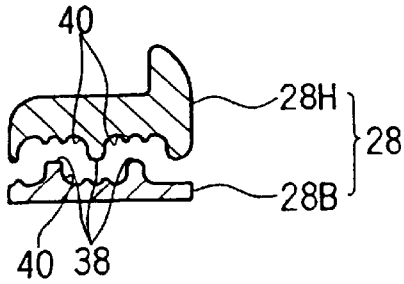
FIG. 17C is a sectional view along a line III—III in FIG. 17A.

FIG. 16 shows an enlarged fitting structural body 50 according to the second embodiment of the invention in the vicinity of the slope 18D of the culvert 18, similarly to FIG. 2. FIG. 17 shows pressing fittings 52H and 54H and embedded fittings 52B and 54B included in the fitting structural body 50. Components, members and such same as those of the first embodiment will be marked with the same reference numbers and omitted from description hereinafter.

In the fitting structural body 50 according to the second embodiment, the pressing fittings 52H and 54H are unified on the both sides of the corner portions 30 and 32 by dividing the pressing fittings 26H at the center thereof, substantially the same as the fitting structural body 10 shown in FIG. 5. Likewise, the embedded fittings 52B and 54B are also formed to correspond to the pressing fittings 52H and 54H and unified on the both sides of the corner portions 30 and 32.

Further, the pressing fittings 52H and 54H are processed at the corner portions 30 and 32 so that the surfaces 30T and 32T with which the upper sheet 22 contacts would have a curvature. The pressing fittings 52H and 54H are curved in an arc with a radius of curvature R in the vicinity of the corner portions 30 and 32 in a view of the longitudinal side of the fittings 52H and 54H.

The pressing fitting 52H is symmetric in relation to an axis line J1 passing through the corner portion 30. The anchor bolt inserting holes 42 are also symmetrically provided in relation to the axis line J1. Thus, on job site, the pressing fittings 52H can be mounted without checking right and left of the axis line J1. In the case that the pressing fittings 52H are used in the fitting structural body 50, the single shape of pressing fittings 52H can be used in common. For example, the fitting structural body 50 is often structured to form substantially a square frame, and the pressing fittings 52H can be used at the respective four corners of the frame in common.

While one side (the upper side in FIG. 16) of the pressing fittings 54H in relation to the axis line J1 is extended so that the pressing fittings 54H would be longer than the pressing fittings 52H for the extended part, the pressing fittings 54H are also symmetric in the vicinity of the axis line J1 and the anchor bolt inserting holes 42 are also symmetrically provided. Thus, in manufacturing the pressing fittings 52H and 54H using a mold, a mold for forming the pressing fitting 54H is used as it is. A core is placed in the same mold when forming the pressing fitting 52H. Accordingly, the mold can be common to form the pressing fittings 52H and 54H, and the pressing fittings 52H and 54H can be efficiently manufactured. The pressing fittings 52H and 54H may also be manufactured individually using different molds.

The embedded fittings 52B and 54B are curved so as to correspond respectively to the curved shape of the pressing fittings 52H and 54H. The thickness of the embedded fittings 52B and 54B are adjusted so that the lower sheet 20 and the upper sheet 22 can be certainly gripped between the pressing fittings 52H and 54H.

The pressing fittings 52H and 54H are provided so as to be symmetric in relation to an axis line J2 thereof at the curved part with a whole of the pressing fittings 52H and 54H (i.e. a corner portion 56 of the fitting structural body). Accordingly, all of the anchor bolt inserting holes 42 at the corner portion 56 are symmetrically positioned in relation to the axis line J2.

The anchor bolt inserting holes 42 located outside the corner portion 56 among the anchor bolt inserting holes 42 provided in the pressing fittings 52H and 54H are arranged to be elongated holes. Thus, the difference in mounting the pressing fittings 52H and 54H is absorbed and the work efficiency is improved in gripping the lower sheet 20 and the upper sheet 22.

Gaps 58 are formed between the pressing fitting 24H of the bottom wall 18L and the pressing fitting 52H, between the pressing fittings 52H and 54H and between the pressing fitting 54H and the pressing fitting 28H of the sidewall 18S. The gaps 58 absorb the difference between the fittings in gripping the lower sheet 20 and the upper sheet 22, and the work efficiency is improved. The gaps 58 between adjacent fittings is preferably from 5 to 10 mm to absorb the difference as well as obtain a great gripping power acting on the lower sheet 20 and the upper sheet 22.

In the second embodiment, the pressing fittings are made into one body on the both sides of the corner portions 30 and 32, similarly to the first embodiment. Therefore, even when the gripped upper sheet 22 inflates and the large tension acts in the vicinity of the corner portions 30 and 32, the upper sheet 22 can be prevented from being damaged.

Especially in the second embodiment, the pressing fittings 52H and 54H are processed at the corner portions 30 and 32 so that the surfaces 30T and 32T with which the upper sheet 22 contacts have a curvature, and thereby, the pressing fittings 52H and 54H are curved in an arc with a radius of curvature R in a view of the longitudinal side of the fittings 52H and 54H. Thus, there are no acute parts at the corner portions 30 and 32, and the upper sheet 22 can be more certainly prevented from being damaged.

The radius of curvature R in processing the corner portions 30 and 32 to have a curvature is not particularly limited, but is preferably 50 mm or greater, and more preferably, 100 mm or greater in order to prevent the upper sheet 22 reliably from being damaged. An excessively large radius of curvature R results in the larger and thicker pressing fittings 52H and 54H and deteriorating the adaptability to the target structure (such as the culvert 10). Therefore, in view of the above, the radius of curvature R is preferably 1800 mm or smaller, and more preferably 400 mm or less. In this embodiment, the radius of curvature R is 200 mm, and the above two effects can be achieved ideally.

The number of the pressing fittings included in the corner portion 56 is not particularly limited so long as the pressing fittings 52H and 54H are processed at the corner portions 30 and 32 to have a curvature. For example, the pressing fittings 52H and 54H may be made into one body.

Figure 18:
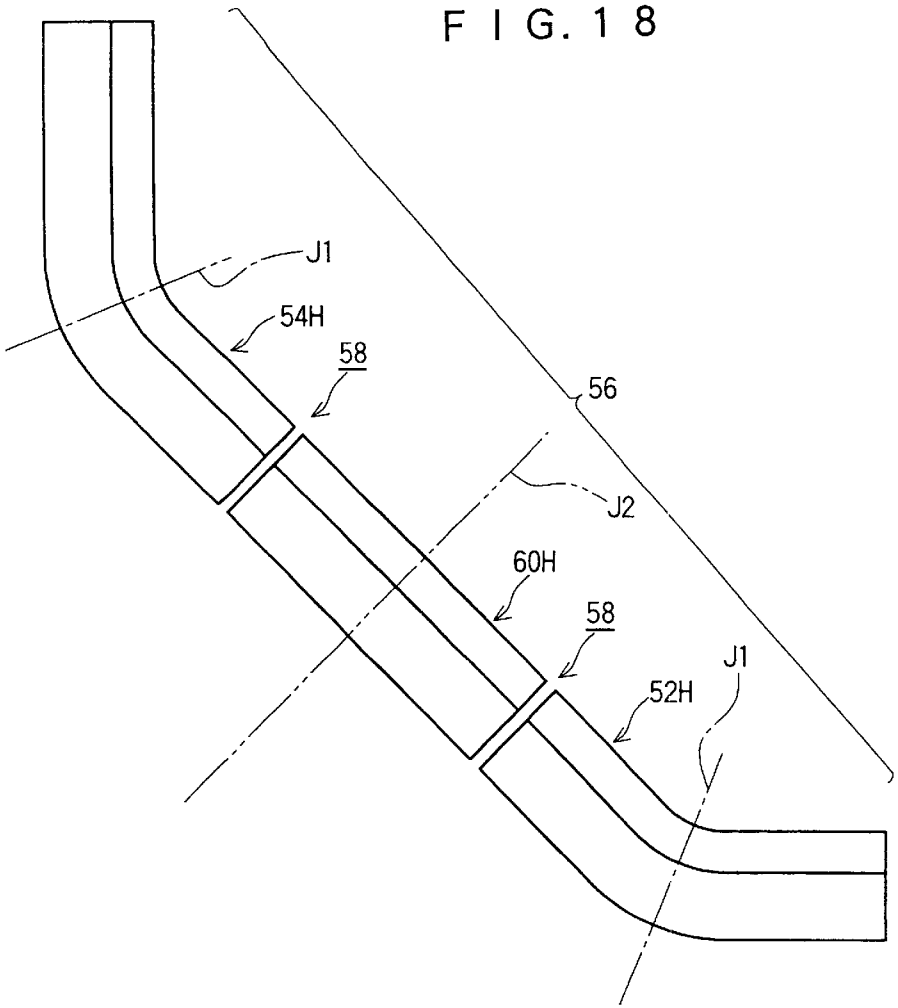
FIG. 18 is an illustration of an embodiment of a fitting structural body according to the second embodiment of the invention, in which intermediate pressing fittings are further provided.
Figure 19:
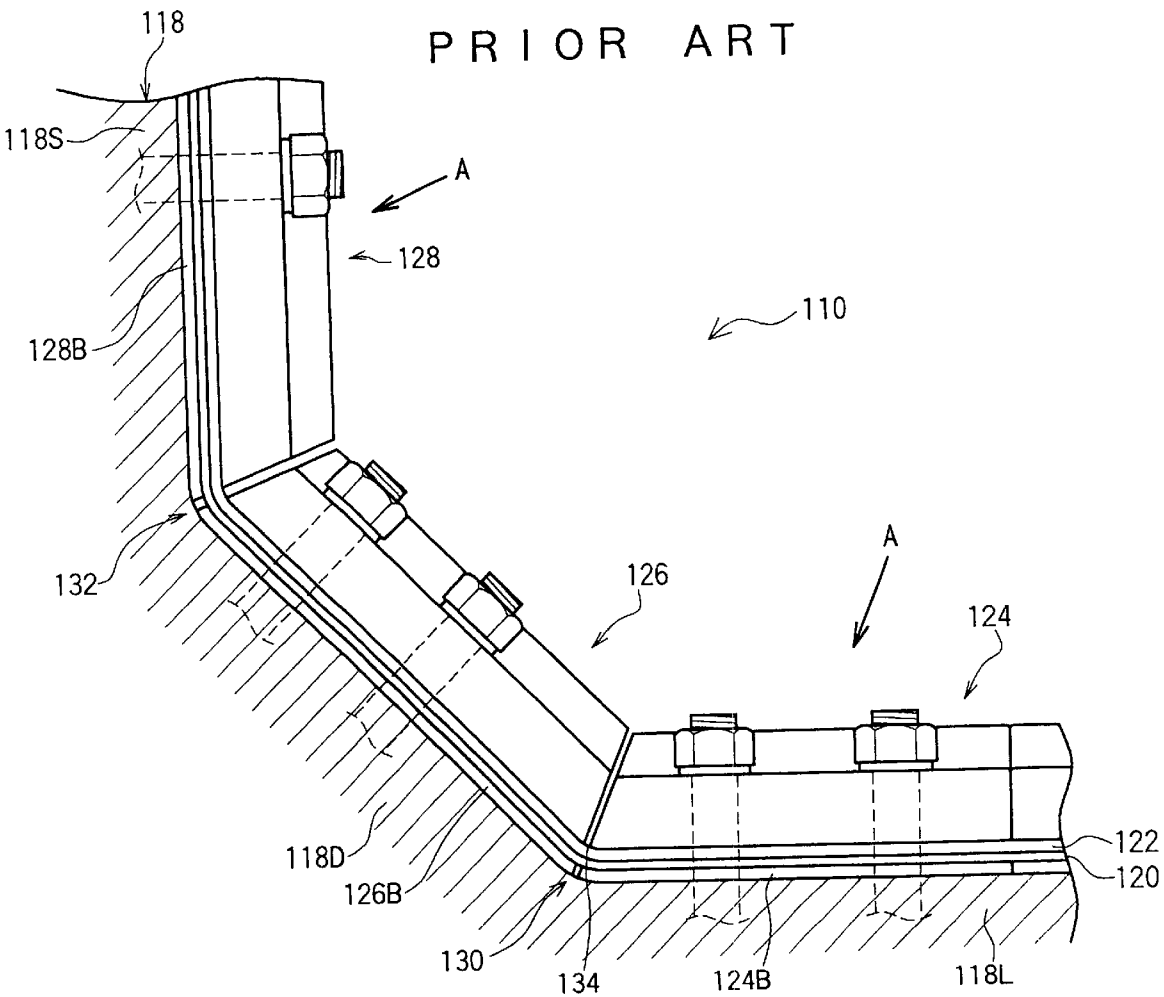
FIG. 19 PRIOR ART
FIG. 19 is an end view of a partially enlarged fitting structural body according to prior art.

Especially, when the corner portion 56 is long, a linearly formed intermediate pressing fitting 60H may be provided between the pressing fittings 52H and 54H, as shown in FIG. 18. Then, the intermediate pressing fitting 60H makes it possible to correspond to a longer corner portion 56 without changing the shape of the pressing fittings 52H and 54H. In this case, the gaps 58 are preferably provided between the pressing fittings 52H and 60H and between the pressing fittings 54H and 60H so as to improve the work efficiency.

Furthermore, in the fitting structural body 10 of respective embodiments shown in FIGS. 2 through 6 and 8 through 15 as the first embodiment, the corner portions 30 and 32 may be processed so as to have a predetermined radius of curvature R.

In the arrangement in the embodiments described above such that two or more anchor bolts 34 are inserted in one set of pressing fittings, it is preferable to provide the anchor bolt inserting holes 42 in respective pressing fittings (refer to FIG. 3A) in parallel so as to arrange all of the anchor bolts 34 in parallel because of a larger tightening power when the nuts 36 tighten the anchor bolts 34, comparing with a case that the anchor bolts 34 are not in parallel. For example, in the pressing fittings 26H shown in FIGS. 4, 5, 7 and 14, the anchor bolts 34 are not in parallel, and thus, tightening the nuts 36 causes a power on the anchor bolts 34 such that the anchor bolts would separate from each other. Additionally, influence of such as gaps and deformation by compression between the upper sheet 22 and the lower sheet 20 may weaken the tightening power of the nuts 36. In contrast, in the pressing fittings 26H shown in FIGS. 2, 6, 8, 9, 11, 12, 13 and 15, the anchor bolts 34 are all in parallel, and thus, tightening the nuts 36 causes no power on the anchor bolts 34 such that the anchor bolts would separate from each other, and a larger tightening power can be obtained.

It is preferable to provide on the head portion of the anchor bolt 34 and the nut 36 a cap 44 for covering the head portion and the nut 36 as shown by a double broken line in FIG. 3A so that the upper sheet 22 is not damaged even when the inflating upper sheet 22 expands and contacts therewith. The form of the cap 36 is not limited so long as the cap 36 has no acute portions in order to prevent the upper sheet 22 from being torn or damaged as described above. The material is not particularly limited to, but preferably may be an elastic material such as rubber because the upper sheet 22 is reliably prevented from being torn or damaged.

An embodiment of the flexible sheet inflatable gate 16 according to the invention is what is mounted to the culvert 18 in the above description. The flexible sheet inflatable gate 16 according to the invention, however, is not limited to an application to the culvert 18. For example, it may be what is disposed on a riverbed and a bank continuously so as to be able to dam a river flow (such as a flexible sheet dam) A fluid to be supplied to the flexible sheet inflatable gate 16 (between the lower sheet 20 and the upper sheet 22) is also not limited to air as described above and may be for example gas other than air or liquid (such as water and oil).

Further, the shape of a cross-section of respective fittings (the pressing fittings and the embedded fittings) comprising the fitting structural body is not limited to what has the convex portion 38 and the concave portion 40 as described above. For example, the respective fittings may be fittings without such convex portion 38 and concave portion 40.

The way of manufacturing the pressing fittings and the embedded fittings is also not particularly limited. The embedded fittings may be formed into a predetermined bent shape as described in the respective embodiments of the invention (or may be in a linear shape in some cases) by processing after they are formed linearly through a heat press process, for example, since the thickness of the embedded fittings is generally thin. Particularly, the heat press process is preferable since the length of a product to be formed can be determined discretionary. In contrast, the pressing fittings are often thick in general, and the process for bending may be difficult. Therefore, the pressing fittings in a desired shape can be manufactured by molding, as described above.

The fitting structural body and the flexible sheet inflatable gate according to the present invention are arranged as described above and thus, can be mounted on a target structure without damaging a flexible sheet.

What is claimed is:

1. A fitting structural body structured to form a frame as a whole, including corner portions of a non-linear part, using fittings for gripping a flexible sheet, which inflates in accordance with supplying a fluid and deflates in accordance with discharging the fluid, and the fittings fixed to a target structure of the fitting structural body, wherein the fittings on the both sides of the non-linear part are unified to remove acute portions at the corner portions of the non-linear part formed along a longitudinal direction of the frame.

2. The fitting structural body of claim 1, wherein the fittings are provided on the non-linear part formed along a longitudinal side of the frame and the fittings are unified on the both sides of the non-linear part.

3. The fitting structural body of claim 1, wherein the fittings are unified by welding individually formed fitting elements so as to form the both sides of the non-linear part.

4. The fitting structural body of claim 2, wherein the fittings are unified on the both sides of the non-linear part by cutting an elongated member so as to correspond to the shape at the non-linear part, the elongated member elongated in the longitudinal direction and longer than the length of the fitting structural body.

5. The fitting structural body of claim 2, wherein the non-linear part of the fittings is processed to have a curvature in a longitudinal view of the frame.

6. The fitting structural body of claim 3, wherein the non-linear part of the fittings is processed to have a curvature in a longitudinal view of the frame.

7. The fitting structural body of claim 4, wherein the fittings are provided with anchor bolt inserting holes for fixing to the target structure, into which anchor bolts are inserted.

8. The fitting structural body of claim 4, wherein a gap is formed between at least one of the fittings and at least one of adjacent fittings to the fittings.

9. The fitting structural body of claim 5, wherein the non-linear part of the fittings is processed to have a radius of curvature of 50 mm or greater and 1800 mm or smaller.

10. The fitting structural body of claim 6, wherein the non-linear part of the fittings is processed to have a radius of curvature of 50 mm or greater and 1800 mm or smaller.

11. The fitting structural body of claim 7, wherein the anchor bolt inserting holes of the fittings are all provided in parallel.

12. The fitting structural body of claim 7, wherein the fittings are formed symmetrically in relation to a symmetric axis line passing through the non-linear part and wherein the anchor bolt inserting holes are provided symmetrically in relation to the symmetric axis line.

13. The fitting structural body of claim 9, wherein, among the fittings fixed to the target structure, relatively upper fittings press relatively lower fittings adjacent to the upper fittings against the target structure.

14. The fitting structural body of claim 9, where in the fittings are provided with anchor bolt inserting holes, which are provided on the target structure, and into which anchor bolts are inserted.

15. The fitting structural body of claim 10, wherein a contacting part of the fittings, which contacts with a part of adjacent fittings to the fittings, is inclined in relation to a fixing direction of the fittings so as to press the adjacent fittings against the target structure.

16. The fitting structural body of claim 11, wherein the anchor bolt inserting holes are provided symmetrically in relation to a symmetric axis line passing through a center point of a corner portion of the fitting structural body.

17. The fitting structural body of claim 12, wherein at least one of the anchor bolt inserting holes in the fittings is an elongated hole.

18. A flexible sheet inflatable gate, comprising:

a flexible sheet for inflating in accordance with supplying a fluid and deflating in accordance with discharging the fluid; and a fitting structural body structured to form a frame as a whole using fittings for gripping the flexible sheet, and being fixed to a target structure of the inflatable gate, wherein the fittings are unified to remove acute portions at corner portions on the both sides of and non-linear part formed into a non-linear shape along a longitudinal side of the frame, and a contacting part of the fittings, which contacts with a part of adjacent fittings to the fittings, is inclined in relation to a fixing direction of the fittings so as to press the adjacent fittings against the target structure.

19. The flexible sheet inflatable gate of claim 18, wherein, among the fittings fixed to the structure for mounting, relatively upper fittings press relatively lower fittings adjacent to the upper fittings against the target structure.

20. The flexible sheet inflatable gate of claim 18, wherein a gap is formed between at least one of the fittings and at least one of adjacent fittings to the fittings.

* * * * *